US011015295B1

(12) United States Patent
Klungness

(10) Patent No.: US 11,015,295 B1
(45) Date of Patent: May 25, 2021

(54) PAPERMAKING SYSTEM AND METHOD

(71) Applicant: John H. Klungness, Bayfield, WI (US)

(72) Inventor: John H. Klungness, Bayfield, WI (US)

( * ) Notice: Subject to any disclaimer, the term of this patent is extended or adjusted under 35 U.S.C. 154(b) by 0 days.

(21) Appl. No.: 16/681,147

(22) Filed: Nov. 12, 2019

(51) Int. Cl.

| | |
|---|---|
| ***D21H 23/04*** | (2006.01) |
| ***D21D 1/20*** | (2006.01) |
| ***D21H 17/67*** | (2006.01) |
| ***D21H 17/70*** | (2006.01) |
| ***D21F 7/00*** | (2006.01) |
| ***D21F 3/02*** | (2006.01) |
| ***D21H 15/02*** | (2006.01) |

(52) U.S. Cl.
CPC ..... *D21H 23/04* (2013.01); *D21D 1/20* (2013.01); *D21F 3/02* (2013.01); *D21F 7/008* (2013.01); *D21H 15/02* (2013.01); *D21H 17/675* (2013.01); *D21H 17/70* (2013.01)

(58) Field of Classification Search
CPC ..... D21H 23/04
See application file for complete search history.

(56) References Cited

U.S. PATENT DOCUMENTS 2,062,442 A * 12/1936 Campbell ..... D21H 17/675 162/181.3
2,935,437 A * 5/1960 Taylor ..... D21H 17/70 162/181.6
2003/0094252 A1* 5/2003 Sundar ..... D21H 17/70 162/128
2004/0118542 A1* 6/2004 Richard ..... D21H 17/70 162/183
2010/0212853 A1* 8/2010 Klungness ..... D21H 17/70 162/181.4
2013/0028828 A1* 1/2013 Lujano ..... B01J 49/53 423/422

FOREIGN PATENT DOCUMENTS

WO WO-2008131819 A1 * 11/2008 ..... D21H 17/70

OTHER PUBLICATIONS

Smook, Handbook for Pulp and Paper Technologists, 1992, Angus Wilde Publications, 2nd edition, chapters 13 and 16. (Year: 1992).*

* cited by examiner

*Primary Examiner* — Anthony Calandra

(57) ABSTRACT

A method of making paper is described. The method includes providing a cellulosic fibrous material, the cellulosic fibrous material comprising a plurality of elongated fibers having a fiber wall surrounding a hollow interior, the fibrous material having moisture content. The method also includes adding calcium bicarbonate solution to the cellulosic fibrous material to form a pulp mixture, the calcium bicarbonate solution containing up to the saturation level of about 16% solids of calcium bicarbonate, the resulting pulp mixture having between 0.1% to 65% total solids by weight. Further, the method includes refining the pulp mixture such that at least some of the calcium ions become associated with the reactive sites in the fiber walls. Further still, the method includes forming a web from the pulp mixture and wet pressing the web.

6 Claims, 1 Drawing Sheet

PAPERMAKING SYSTEM AND METHOD

REFERENCE TO PRIORITY APPLICATIONS

This application claims priority to U.S. Provisional Application No. 62/760,543, to inventor John H. Klungness, filed on Nov. 13, 2018, the entirety of which is herein incorporated by reference.

BACKGROUND

Over the past half century, there has been considerable research into the parameters controlling press dewatering. Previous efforts to improve press dewatering have, with limited success, focused on changing the equipment used in the process. Out of necessity, this requires significant capital investment for development and commercialization. The last major improvement in press dewatering, extended nip pressing, requires complete replacement of a portion of the press section. It was introduced in the early 1980's and still has not reached full market saturation. Other technologies (impulse drying and displacement dewatering) have not fared well either, at least in part due to the significant capital investment required.

During the same time period, there has also been considerable research into the manipulation of sheet physical properties through refining, chemical addition, and filler addition. These studies sometimes address the impact on sheet formation, but usually from the standpoint of final sheet properties. This work generally ignores the impact of sheet and fiber changes on sheet dewatering.

There is a need for a system and method of fiber loading (in situ formation of precipitated calcium carbonate) that can enhance sheet properties relative to sheets made using traditional filler addition methods as well as enhancing wet pressing water removal. Present knowledge needs to be synthesized to optimize press dewatering of filler loaded fibers.

SUMMARY

An exemplary embodiment relates to a method of making paper. The method includes providing a cellulosic fibrous material, the cellulosic fibrous material comprising a plurality of elongated fibers having a fiber wall surrounding a hollow interior, the fibrous material having moisture content. The method also includes adding calcium bicarbonate solution to the cellulosic fibrous material to form a pulp mixture, the calcium bicarbonate solution containing up to the saturation level of about 16% solids of calcium bicarbonate, the resulting pulp mixture having between 0.1% to 65% total solids by weight. Further, the method includes refining the pulp mixture such that at least some of the calcium ions become associated with the reactive sites in the fiber walls. Further still, the method includes forming a web from the pulp mixture and wet pressing the web.

Another exemplary embodiment relates to a method of making paper. The method includes providing a cellulosic fibrous material, the cellulosic fibrous material comprising a plurality of elongated fibers having a fiber wall surrounding a hollow interior, the fibrous material having moisture content. The method also includes adding calcium bicarbonate solution to the cellulosic fibrous material to form a pulp mixture, the calcium bicarbonate solution containing up to the saturation level of about 16% solids of calcium bicarbonate, the resulting pulp mixture having between 0.1% to 5% total solids by weight. Further, the method includes refining the pulp mixture such that at least some of the calcium ions become associated with the reactive sites in the fiber walls. Further still, the method includes forming a web from the pulp mixture and wet pressing the web.

In addition to the foregoing, other system aspects are described in the claims, drawings, and text forming a part of the disclosure set forth herein. The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the disclosures set forth herein.

BRIEF DESCRIPTION OF THE DRAWINGS

The use of the same symbols in different drawings typically indicates similar or identical items unless context dictates otherwise.

DETAILED DESCRIPTION

Figure 1:
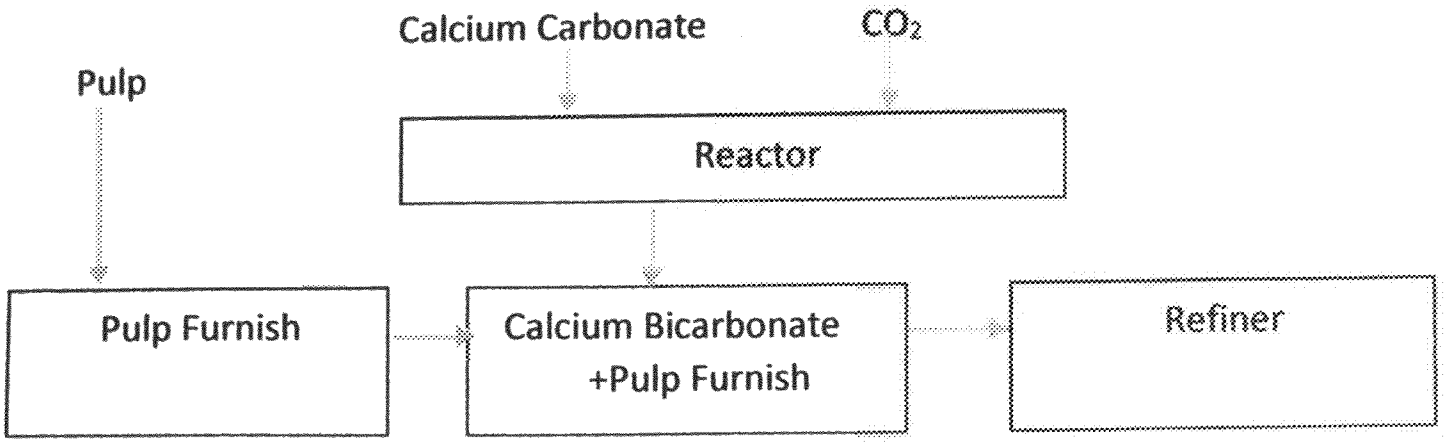
FIG. 1 is a process diagram of an embodiment of the paper making process in accordance with the invention.

Referring to FIG. 1, a generalized process for papermaking in accordance with exemplary embodiments is depicted. The process provides a method of combining precipitated calcium carbonate (PCC) with a pulp slurry (pulp and water mixture). The method then causes the dissolving of the PCC in the presence of added CO2. The entire mixture is then refined to cause reprecipitation of PCC.

Figure 2:
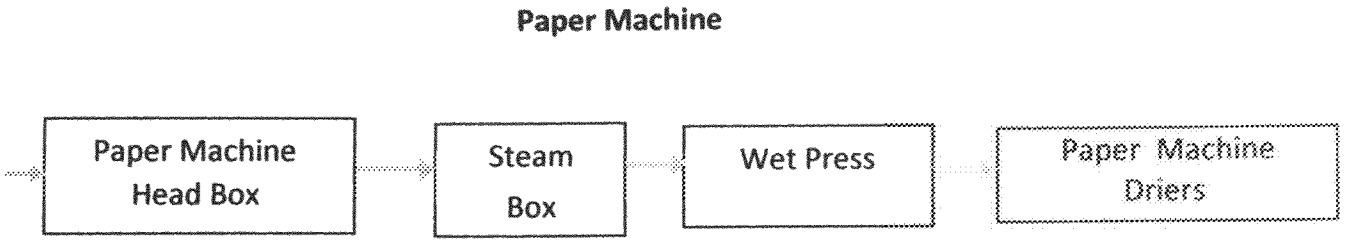
FIG. 2 is a machine diagram of papermaking machine configured for the process of FIG. 1.

The method of FIG. 1 may be carried out in a papermaking machine generally depicted in FIG. 2. The Papermaking machine may include, but is not limited to a Paper Machine Head Box, where the mixture is formed, a wet press, where at least some of the water may be removed. The Papermaking machine may also include a dryer section configured to remove any excess water still remaining within the sheet.

Rewetting

One of the most interesting and controversial subjects in wet pressing research is the rewetting phenomena. Rewetting refers to the re-adsorption of water into the web (nip rewetting) in the later part of the press nip or subsequently before the web is separated from the felt (post-nip rewetting).

Walstrom (1969) showed that felt batt diameter was the most important factor for rewetting and that grammage and paper machine speed had no effect on rewetting. Post nip rewetting occurs after the press nip if paper web is in contact with the press felt (Busker, Cronin 1984).

The mechanism of nip rewetting is less clear due in part that it is difficult to measure. It has been suggested that felt expansion after mid-nip is controlling mechanism that limits rewetting, opposing the effect of web expansion based on studies where an incompressible pressing media was used (Jaavidaan et al. 1988; Luotonen, Sampi 1995).

McDonald and Kerekes (1991) complied rewetting from earlier studies and found them varying in the range from 2 to 72 g/m2. They developed a permeability model and found good agreement with mill scale measurements.

Sheet and Fiber Water

In conventional pressing, water removal is induced by compressing the sheet. Sheet compression results in a decrease in average pore size and increase in apparent density. Using peak pressures of up to 7,000 kPa (1000 psi), the maximum solids attainable in most press sections is 45% to 50%. Sheet property constraints and lifetime limitations often prohibit using press loads of that magnitude. The 40% to 45% solids level represents about the same amount of water as is found in the inter-fiber pores, i.e., inter-fiber water or free water (Maloney et al., 1998).

Inter-fiber water is contained in the pore spaces between the fibers. These pores generally have diameters of 1 μm or greater.

Intra-fiber water is the water contained in pores that exist in the fibers. These pores generally have diameters that range in size from <0.01 to about 0.05 μm. Water in pore spaces ranging in size from 0.025 to 0.05 μm is not bonded to the fiber and can be removed mechanically.

The amount of unbonded intra-fiber in fiber is about 1.4 to 1.5 g/g (42% solids) (Carlsson, Lindstrom, Soremark, 1977). A portion of intra-fiber water (about 0.4 g/g) forms hydrogen bonds with the fibers and is contained in the fiber wall in pores smaller than 25 Å (or 0.0025 μm) (Stone et al., 1966). The amount of hydrogen bonded water does not vary significantly for different pulps or different levels of refining. This water cannot be removed mechanically, as its removal requires heating to break the hydrogen bonds. It constitutes the limit of water removal by mechanical means and represents a sheet solids content of 1/(1+moisture ratio))=1/(1+0.4)=0.71 or 71% (Fiber Saturation Point).

Is only inter-fiber water removed in the press section? Experiments indicate that intra-fiber water is also removed in the nip (Carlsson, 1983). Therefore, the low solids levels attained in conventional pressing imply that the water removal process is not a serial process in which all the free water is removed and then the intra-fiber water is removed. As the sheet is compressed, some intra-fiber water is pushed into the inter-fiber spaces and a portion of it may reach the felt. Some of the inter-fiber water also enters the felt. However, some inter-fiber water may be absorbed by the fibers, thus becoming intra-fiber water. This process is beneficial for development of sheet strength but at the same time limits water removal by conventional pressing. Eventually, all the inter-fiber water is removed, although in actual practice some of it may be removed by drying.

Robertson (1963) described what happens to the web as the water is removed: The saturated web that is first formed derives its strength from fiber entanglement and inter-fiber friction forces. Fiber flexibility contributes to increased floc strength and wet web strength. The removal of water produces increased strength by compression of the pad by surface tension effects up to the point of air intrusion. Air intrusion is determined by the web compressibility and pore size distribution. Pore size distribution is a function of fiber size and fibrillation.

As the inter-fiber pores are emptied of water, the web may expand or contract, depending on whether it is predominantly plastic or elastic. Webs made of high yield pulp tend to be more elastic.

As the inter-fiber water is removed, further water removal requires collapse of fiber structure. Surface tension tends to draw the fiber together, increasing fiber-fiber contacts. Fibrils collapse onto the parent fiber or each other; fiber walls are flattened to form extended areas of inter-fiber contact. Caliper reduction occurs and with highly fibrillated fibers planar shrinkage occurs. The strength of the web is still a result of surface tension forces, but the forces are now acting on large surfaces in close contact and the radii of curvature of the menisci are small.

Hydrogen bonding does not occur until after the fibers are collapsed and the lumen water is removed.

Fiber/Lumen Loading

In conventional papermaking, fillers are added for two primary purposes (1) modify the final sheet physical properties (optical properties or print quality properties), and (2) replace fiber with lower cost nonfiber materials. Fillers used just to modify physical properties can be expensive (e.g., titanium dioxide used for sheet brightness and opacity). Filler used for fiber replacement are of necessity low cost (e.g., kaolin clay, calcium carbonate).

In using fillers, the primary problem is retention of filler particles in the forming section of the paper machine. Polymers are used to modify the filler and/or the fiber surfaces charges and promote attachment of the filler particles to the fiber surfaces. Always some filler materials drain through the web and enter the paper machine white water system, not all of which is recovered. An additional problem is that sheet strength is reduced when conventional filler techniques are used. The filler particles adhere to the exterior of the fibers and decrease the surface area available for fiber-fiber bonding.

The shift to alkaline conditions in papermaking was prompted by the increased level of filler permitted in alkaline-sized papers. Because alkaline conditions enhance paper strength, a higher level of filler can be incorporated into the sheet. Calcium carbonate, filler that could not be used in acid-sized papers, is popular as filler in alkaline-sized papers because of its high brightness level (Gill and Scott, 1987; Downs, 1990).

A method to incorporate filler into the lumen of wood fibers has been the subject of extensive research. Scallan and associates (Green et al., 1982; Scallan and Middelton, 1985) reported the first studies as lumen loading. An excess of titanium dioxide was mechanically mixed with a pulp slurry depositing titanium dioxide within the fiber lumen. However, limitations of this method were the large excess of titanium dioxide required for lumen loading and the need of a separate process for recycling the excess filler. More recent studies on cell wall loading have been reported by Allan and associates (Allan et al., 1992). Their approach was to saturate pulp fibers with sodium carbonate and react the resulting a pulp mixture with a salt-containing calcium (e.g., calcium chloride). However, additional processing was required to remove the salt remaining in the mixture.

The fiber-loading technology, developed at the USDA Forest Service, Forest Products Laboratory, consists of two steps (Klungness et al., 1993). First, calcium hydroxide is mixed into pulp fiber slurry. Then, the pulp and calcium hydroxide mixture are reacted using a high consistency pressurized reactor (refiner or disk disperser) under carbon dioxide pressure to precipitate calcium carbonate. The calcium carbonate formed is termed fiber-loaded precipitated calcium carbonate (FLPCC). The technology increases brightness, opacity, bonding properties, and runnability of the paper machine.

We estimated the capital effectiveness of fiber loading with regard to producing lightweight high-opacity newsprint. Fiber loading allows fiber bonding at increased precipitated calcium carbonate levels without significant loss in Canadian Standard Freeness (CSF) (an arbitrary measurement of water drainage) or additional use of energy. We investigated the return on investment (ROI) for FLPCC for a hypothetical 600 metric ton/day newsprint mill. Savings were obtained from substituting lower cost FLPCC for higher cost fiber, reducing grammage and drying energy costs, and obtaining a premium for lightweight paper. Fiber loading produces a positive ROI, given typical engineering costs. Assuming that a 4-g/m2 reduction in fiber and a 6% addition of precipitated calcium carbonate is a reasonable goal for fiber-loaded newsprint, high ROIs can be reached. Assuming that FLPCC is available at $150/metric ton and 1% hydrogen peroxide is added along with typical stabilizing chemicals, the ROI is estimated to be 59.7%. If the cost of FLPCC is $75/metric ton, the ROI is estimated to be 73.4% (Klungness et al., 1999). The above economics are based on using expensive high consistency fiber-loading reactors. If conventional equipment, such as double-disk refiners, can be used at consistencies of about 5%, the ROIs are very much improved. This work did not have as its primary objective to decrease dryer section energy use.

Fiber/Lumen Loading—Previous Pilot-Scale Work

There are two published industrial evaluations of fiber loading. The first evaluation (Klungness et al., 1995) involved fiber loading virgin never-dried birch hardwood bleached Kraft pulp. The fiber-loaded pulp was processed on a pilot-scale paper machine. The paper machine trials revealed some technical obstacles. Changes in color and brightness, cross machine web shrinkage, and apparent density increases were observed and became the focus of the follow-up laboratory evaluations following these trials. The problems were duplicated in the laboratory, and methods for preventing or overcoming the obstacles were developed.

It was demonstrated that including a low level of hydrogen peroxide prevented brightness loss and yellowing of the fiber-loaded pulp. Web shrinkage was tracked to greatly improved water removal for fiber-loaded pulps compared to the conventional. Web shrinkage occurred before the paper machine cross-machine-direction restraint rolls. This was due to improved water removal. Filler retention was shown not to be a problem with fiber-loaded pulps. Apparent density was increased by about 10% for fiber-loaded pulps. Laboratory hand sheet experiments demonstrated that increased use of TMP pulp restored the loss in bulk.

The second published industrial evaluation of fiber loading involved deinked mixed office waste (Heise et al., 1996). Conventional deinking mill conditions were simulated. Industrial-scale fiber loading was technically successful; calcium hydroxide was completely converted to calcium carbonate and deposited on the external and internal surfaces of pulp fibers. The fiber-loading processes used in the trials needed to be modified to obtain optimum conversion to calcium carbonate.

The term "hot pressing" has been used to refer to two different technologies, both of which have the objective of reducing water viscosity and fiber compressive strength. These, in turn, result in increased water removal due to reduced hydraulic pressures in the web and reduced fiber/web springback. One technique referred to as "hot pressing" is the use of multiple steam boxes before and in the press section of the paper machine (Cutshall, 1987). There are two primary complications to this technology. Modern paper machines have extremely compact press sections and it is difficult to fit multiple steam boxes into a machine that was not specifically designed for that purpose. A second potential problem is decreased web permeability due to refining; high recycle content, or both.

The second technique of "hot pressing" is to use a heated pressing surface. Hot pressing differs from impulse drying in that the pressing surface is kept at temperature below the boiling temperature of water. The delamination issues associated with impulse drying are therefore not of concern.

Advances in the Art

We have determined that using pulp mixture solids from 0.1% to 5% solids provides significant benefits to what has previously conceived. The use of pulp mixtures between 5% and 60% solids has been previously (Klungness 2014). In accordance with an exemplary embodiment the pulp to be processed is to be in the form of a crumb pulp, i.e. the fibrous material has a moisture present at a level sufficient said cellulose fibrous material in the form of dewatered crumb pulp.

However, a great deal of wood pulp is processed as a slurry, below the claimed solids and thus it would be advantage to use existing conditions and processing equipment for our method to use lower solids. Using lower solids (0.1% to 5%) is unexpected as prior to this high solids (5% to 60%) have been used in order to permit near field reaction to occur in order to result in calcium being deposited within the cell wall of wood pulp fibers. However, it has been shown that high solids pulp is produced very briefly during processing in a pressurized refiner between rotating refiner plates.

Unexpectedly, low solids pulp mixtures as a feed to pulp refiners result, under proper refiner plate gap, temperature, and chemical addition, in calcium depositing within the fiber cell walls thus displacing bound water from the cell walls. The resulting solids of wet pressed pulp web are higher than without this method using lower solids.

Scanning electron microscopy (SEM) analysis revealed the presence of PCC crystals on both external fiber surfaces and within the cell lumen. X-ray microprobe analysis identified the presence of calcium within the cell wall (Klungness et al., 1994). Also, it was observed that the FLPCC crystals on the surface if the fibers were very small and the FLPCC crystals within the lumen larger (standard 1.4 μm). This shows that not only were the FLPCC particles formed by reacting calcium hydroxide and carbon dioxide, that excess carbon dioxide reacted with water for form carbonic acid. The carbonic acid formed then reacted with the FLPCC to form calcium bicarbonate. Calcium bicarbonate is only soluble in water to about 16%. During processing in wet pressing the pulsing action of the pressing would repeatedly raise and lower the water solids between the 16% solubility of calcium bicarbonate. The calcium bicarbonate would precipitate as fine particles of PCC (and possibly dissolve again). The calcium ions from the calcium bicarbonate have then also displaced bound water attached to carboxyl and carbonyl reactive groups within the fiber wall.

In summary these observations indicate three reactions occur during fiber loading:

PCC is formed as normal 1.4 μm diameter PCC particles

PCC is formed on the surface of the fibers as small as 0.05 μm (or lower) PCC particles Calcium ions have been deposited in the cell walls.

These (non-obvious) observations suggest that adding calcium bicarbonate directly will result in simplifying and improve water removal in wet pressing.

Calcium ions which displace and release bound water from within the fiber wall also prevent rewetting. This includes both nip and post nip rewetting. Reactive hydroxyl and carboxyl sites within the fiber wall are bound with calcium ions and compounds which effectively reduce or prevent rewetting of wet paper webs in the wet pressing process. Preventing rewetting is due in part to stearic hindrances of the calcium ions and compounds deposited in the fiber loading process. The prevention or reduction of rewetting is also facilitated by the neutralization of reactive groups within and on the surface of the cellulose fibers.

When using lower solids, not only does the PCC formed in the reaction displace the bound water, but it prevents rewetting of the eventually wet pressed formed web from this fiber loaded pulp. That is, the water removed during wet pressing becomes more effective by preventing the rewetting during pressing. Such that, as the free water is removed, then the intra-fiber water removed, and finally (as the sheet is compressed), the inter-water is removed from the wet web; all water removed reaches the felt with greatly reduced re-wetting of the wet pressed formed web. This serial process is repeated (pulsed) many times during refining and wet pressing resulting in greatly enhanced water removal during the wet pressing operation.

In accordance with exemplary embodiments, the repeated pulsing of the solids during stock preparation causes small PCC particles to repeatedly and simultaneously form and bond strongly with the fibers. These small and well bonded PCC particles cause higher solids to be reached during wet pressing as well as preventing re wetting during the release of wet pressing.

In our following experiments we focus on dissolving a portion of typical particle sized PCC used in producing paper thereby producing soluble calcium bicarbonate. Then reprecipitating much smaller PCC particles (from the soluble calcium bicarbonate) on and within the fiber walls. By so doing we desire to reduce rewetting during wet pressing of the fiber web, in order to reduce subsequent drying energy during paper manufacture.

Materials

Pulp—The pulp used was a commercial bleached hardwood market pulp supplied by Verso.

Calcium carbonate (PCC)—Commercial paper grade precipitated calcium carbonate was supplied by Specialty Minerals Inc.

Synthetic wet press felts (fabrics) were supplied by Albany International.

Retention aid—Nalco 7546 was supplied by Nalco Inc.

Carbon dioxide—Commercial grade pressurized gaseous carbon dioxide was used.

Equipment

Pulp beating—A commercial laboratory scale Valley beater was used for adjusting the pulp freeness.

Producing calcium bicarbonate—A standard laboratory scale mixer and stainless-steel container was used to bubble carbon dioxide into a mixture of PCC and water.

British Disintegrator—Standard fiberizer used in TAPPI standard procedures for fiberizing pulp for handsheets.

Wet pressing—A pilot scale wet press was used to press handsheets. The wet press was single bottom felted only. The second wet press was used for pressing.

Procedure

Treating PCC-Prepared a mixture of PCC in water sufficient to end with 30% on the weight of pulp to be used in the Valley beater. Bubbled carbon dioxide into the stirred mixture for 4-6 hours or until pH measurement stabilizes around 6.0.

Combined pulp, PCC, and water in the Valley beater at 3.0% consistency and run for 1.5 hours until the freeness is about 350 ml CSF. Diluted pulp mixture to 0.6% consistency. Added Nalco 7546 (mixed under shear at 1% aged for 5 minutes, diluted to 0.1%. Dosage of 1 lb./ton on total dry solids).

Prepared 2.4 g handsheets in Tappi hand sheet mold. Place each hand sheet between two metal hand sheet plates and place in plastic bag to prevent drying. Stored in oven at 1200F until ready to press on the paper machine wet press.

The paper machine wet felt was conditioned by running with a felt washer and pressing before experiments. The felt pads were conditioned before each hand sheet pressing by washing with a hose, pressing and running through a Uhle vacuum box.

Pressed hand sheets in a sandwich (paper machine wet press felt, hand sheet, sample wet press felt). Passed through until a pre-determined number of passes to reach 6.0 g wet weight (40% solids). All the handsheets for a given experimental condition were given the same number of passes. Pressed 25 handsheets per experimental condition.

After pressing each hand sheet was placed in a plastic bag. Determined the dry weight by oven drying. Calculated the water removal for each hand sheet.

The untreated experiment was repeated as the treated PCC experiment except for omitting the carbon dioxide treatment.

Results

TABLE 1 pH and Freeness values for Pulps Processed with Untreated and Treated PCC

| | Untreated PCC PCC plus $H_2O$ | Treated PCC PCC plus $H_2O$ plus $CO_2$ |
|---|---|---|
| pH | 9.68 | 6.09 |
| pH | Add pulp | Add pulp |
| | | 6.74 |
| pH | Beat 1.5 hr. | Beat 1.5 hr. |
| | 8.49 | 8.51 |
| CSF, ml | 350 | 380 |

Adding PCC to pulp resulted in a pH of 9.68 (Table 1). Beating at 3.0% consistency reduced the pH to 8.49- and freeness to 350-ml CSF. An identical pulp mixture was treated with CO2 which lowered the pH from 9.68 to 6.09 due to the formation of calcium bicarbonate from the carbonic acid formed by CO2 and water plus PCC. After again beating the pulp with treated PCC for 1.5 hours, the pH reached 8.51 (close to the 8.49 reached by beating the pulp with the untreated PCC). The similar pH values indicate the treated pulp had much of the calcium bicarbonate converted to PCC.

TABLE 2

Ash Content of Hand Sheet Mold Mixture and Dried Hand Sheets

| | Untreated | Treated |
|---|---|---|
| Hand sheet mold, ash % | 25.6 | 21.3 |
| Dried hand sheet, ash % | 23.0 | 25.4 |
| Retention, ash % | 89.8 | 119.2 |

Retention of ash from the untreated PCC pulp sample before and after hand sheet preparation was 89.8%. This level of retention of PCC was expected. The retention for the treated PCC containing pulp sample was much higher than expected, at 119.2%. The result for the treated PCC suggests that the high solids reached during wet pressing caused further precipitation of unprecipitated calcium bicarbonate during the wet pressing operation. That is, a longer beating time, higher pulp consistency, or both during beating would precipitate more of the calcium bicarbonate (prior to pressing) formed during CO2 treatment.

TABLE 3

Wet Press Water Removal Results for Handsheets Containing Untreated and Treated 23% PCC

| | Untreated | Treated |
|---|---|---|
| Dry Weight, g (Std. Dev.) | 2.44 (0.06) | 2.43 (0.05) |
| Water removed, g (Std. Dev.) | 1.79 (0.19) | 1.87 (0.16) |
| Water removed/dry wt. (g/g) | 0.7324 | 0.769 |
| Apparent density, ($g/cm^3$) | 0.0123 | 0.0124 |

The weight of the dried handsheets and the apparent density of the pressed and dried handsheets were similar at 2.44 and 2.43 g and 0.0123 and 0.0124 g/cm3 (Table 3). The ratio of water removed per gm of dry pulp for the treated pulp with respect to the value for untreated pup was 0.769/07324 or 1.05. That is, there was a 5% drying energy saving realized by treating PCC at the 23% PCC based on total hand sheet weight.

Wet webs containing treated PCC demonstrate improved water removal during wet pressing compared to identical wet webs with untreated PCC. The improvement in wet pressing is due to an increase in filtration resistance of pulp webs containing treated PCC. Treating PCC creates smaller particle size reprecipitated PCC (from calcium bicarbonate) (Klungness et al. 1994). Filtration resistance is proportional to specific surface area which increases with the smaller size of the treated PCC.

During wet pressing wet webs of both treated and untreated PCC perhaps reach similar solids at high mid press nip pressure. But the treated PCC webs leaving the mid nip, have an increased filtration resistance at the reduced pressure, impeding rewetting. The increased filtration resistance results in reduced water rewetting during wet pressing.

In some instances, one or more components may be referred to herein as "configured to," "configured by," "configurable to," "operable/operative to," "adapted/adaptable," "able to," "conformable/conformed to," etc. Those skilled in the art will recognize that such terms (e.g. "configured to") generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

BIBLIOGRAPHY & CITED REFERENCES

Allan, G. G., A. R., Negri, and P. Ritzenthaler, P. (1992). The micro porosity of pulp: the properties of paper made from fibers internally filled with calcium carbonate, *Tappi J.* 75:239.

Busker, L. H., and Cronin, D. C. (1984). The relative importance of wet press variables in water removal, Pulp Pap. Can. 85(6), 87-101.

Carlsson, G. (1983). Some Fundamental Aspects of Wet Pressing of Paper Source: Royal Inst. Technol. (Stockholm), Dr. Technol. thesis: ca. 126 p. (August 1983). [Engl.] cf. ABIPC 54: abstr. 7242, 8478. Royal Institute of Technology, Stockholm.

Carlsson, G., T. Lindstrom, and Soremark, C. (1977). Expression of Water from Cellulosic Fibers Under Compressive Loading Trans. BPBIF Symp. Fiber-Water Interactions in Papermaking (Oxford): 389-402 (September 1977).

Cutshall, K. A., Hudspeth, D., and Long, C. (1987). Ultrahot Pressing through Multiple Steam Shower Application, Conference presentation, TAPPI Papermakers Conf. (Atlanta) Proc.: 301-304 (Apr. 6-8, 1987).

Downs, T (1990). A bright future for calcium carbonate. *Pulp and Paper* 64: 39.Gill, R. and Scott, W. (1987). The relative effects of different calcium carbonate filler pigments on optical properties. *Tappi J.* 70: 93.Global Pulp & Paper (2006). Fact & Price Book 2006, San Francisco, Calif.

Green, H. V. T. J. Fox, and S. Allan (1982). The preparation of lumen loaded pulps, Pulp and Paper Canada, 83:T203.

Heise, O., W., Fineran, J. Klungness, F. Tan, M. Sykes, M., AbuBakr, S., and Eisenwasser, J. (1996). In 1996 *Tappi Pulping Conference Proceedings*, Oct. 27-31, 1996; Nashville, Tenn. Atlanta, Ga.: *TAPPI Press,* 895(1996).

Jaavidaan, J., et al., (1988). Rewetting in the expansion side of press nip. Tappi J., March, 151-155). Klungness, J., D., Caulfield, I. Sachs, M. Sykes, F. Tan, and R. Shilts (1997). Method for fiber loading a chemical compound, U.S. Pat. No. 5,223,090, RE35, 460 February 25.

Klungness, J., D. Caulfield, I. Sachs, F. Tan F., M. Sykes, R. Shilts, (1994). Fiber-loading; a progress report, In 19945 Tappi Recycling symposium, May 13-18, 1994; Boston, Mass.: TAPPI Press, 1994, 283-290.

Klungness, J., M. Sykes, F. Tan, S. AbuBakr, and J. Eisenwasser, J. (1995). Effect of FL on paper properties In *Tappi* 1995 *Papermakers Conference Proceedings*, Tappi Press, Atlanta, p. 553.

Klungness, J. H., Stroika, M. L., Sykes, M. S., Abubakr, S. M., Witek, W., and Heise, O. U. (1999). Engineering analysis of lightweight high-opacity newsprint production by fiber loading, In: 1999 Tappi Joint Conference Proceedings, March 1-4, TAPPI press, Atlanta, Ga., pp 1047-1053.

Klungness, J. H. (2014). Fiber loading improvements in fiber loading, U.S. Pat. No. 8,808,503 B2, August 19.

Luotonen, A., and Sampi, J., (1995). Dewatering in double wire pulp machine-press theory and test results, Tappi Engneering Conference, 641-649.

Maloney, T. C., Johansson, T., and Paulapuro, H. (1998). Removal of water from cell wall during drying, Paper Technology, Paper Technology, (39)6, pp 39-42, 44-47.

Robertson, A. A. (1963). The Physical Properties of Wet Webs, Svensk Papperstidning V, N12 (30 Jun. 1963) pp 477-496.

Stone, J. E., Scallan, A. M., Aberson, G. M. A. (1966). "The Wall Density of Native Cellulose Fibers," Pulp and Paper Magazine of Canada. (May) pp. T263-T268.

Scallan, A. M. and S. R. Middleton (1985). Lumen loaded paper pulp," In: Papermaking Raw Materials, Transactions of the symposium held at Oxford, p. 613.

Vomhoff, H. and Norman, B. ((2001), Method for the investigation of the dynamic compressibility of wet fibre networks, Nordic Pulp and Paper Reseaech Journal. 16(1), 57-61.

Wahlstrom, P. B., (1969), Our present understanding of the fundamentals of pressing, Pulp Pap Can, 349.

What is claimed is:

1. A method of making paper comprising:

combining carbon dioxide, calcium carbonate, and water in a reactor to produce calcium bicarbonate solution;

providing a cellulosic fibrous material, the cellulosic fibrous material comprising a plurality of elongated fibers having a fiber wall surrounding a hollow interior, the fibrous material having moisture content;

adding the calcium bicarbonate solution to the cellulosic fibrous material to form a pulp mixture, the calcium bicarbonate solution containing between 0.5% to 16% solids of calcium bicarbonate by weight, the resulting pulp mixture having between 0.1% to 65% total solids by weight;

refining the pulp mixture such that at least some of the calcium ions from the calcium bicarbonate become associated with the reactive sites in the fiber walls;

forming a web from the pulp mixture; and wet pressing the web.

2. The method of claim 1, further comprising:

drying the web.

3. The method of claim 1, further comprising:

adding energy in a steam box prior to wet pressing the web.

4. A method of making paper comprising:

providing a cellulosic fibrous material, the cellulosic fibrous material comprising a plurality of elongated fibers having a fiber wall surrounding a hollow interior, the fibrous material having moisture content;

adding a calcium bicarbonate solution to the cellulosic fibrous material to form a pulp mixture, the calcium bicarbonate solution containing between 0.5% to 16% solids of carbon bicarbonate, the resulting pulp mixture having between 0.1% to 5% total solids by weight;

refining the pulp mixture such that at least some of the calcium ions from the calcium bicarbonate become associated with the reactive sites in the fiber walls;

forming a web from the pulp mixture; and wet pressing the web.

5. The method of claim 4, further comprising:

drying the web.

6. The method of claim 4, further comprising:

adding energy in a steam box prior to wet pressing the web.

* * * * *